US010731321B1

(12) United States Patent
Lykken et al.

(10) Patent No.: US 10,731,321 B1
(45) Date of Patent: Aug. 4, 2020

(54) COMPACT ARTICULATED-STEERING LOADER

(71) Applicant: MAC Company, LLC, Battle Lake, MN (US)

(72) Inventors: Thomas G Lykken, Fargo, ND (US); Peter J Christianson, Fargo, ND (US)

(73) Assignee: MAC Cormpany, LLC, Battle Lake, MN (US)

( * ) Notice: Subject to any disclaimer, the term of this patent is extended or adjusted under 35 U.S.C. 154(b) by 0 days.

(21) Appl. No.: 16/813,298

(22) Filed: Mar. 9, 2020

(51) Int. Cl.
*E02F 9/08* (2006.01)
*E02F 3/28* (2006.01)

(52) U.S. Cl.
CPC ..... *E02F 9/0841* (2013.01); *E02F 3/28* (2013.01)

(58) Field of Classification Search
CPC ..... E02F 9/0841; E02F 3/28
See application file for complete search history.

(56) References Cited

U.S. PATENT DOCUMENTS

| | | | | |
|---|---|---|---|---|
| 2,726,778 | A | 12/1955 | Hough et al. | |
| 3,007,590 | A | 11/1961 | Stanley et al. | |
| 3,384,196 | A | 5/1968 | Fielding | |
| 3,521,720 | A | 7/1970 | Korotkin | |
| 3,805,908 | A | 4/1974 | Thompson | |
| 3,836,025 | A | 9/1974 | Olson et al. | |
| 3,915,321 | A | 10/1975 | Gorby et al. | |
| 3,921,836 | A | 11/1975 | Wyslouch et al. | |
| 3,937,339 | A * | 2/1976 | Geis | B60G 17/005 414/697 |
| 4,037,681 | A | 7/1977 | Gorby | |
| 4,050,535 | A | 9/1977 | Bosshart et al. | |
| 4,082,197 | A * | 4/1978 | Stedman | B66F 9/0655 212/264 |

(Continued)

FOREIGN PATENT DOCUMENTS

| | | |
|---|---|---|
| DE | 9314191 U1 | 1/1994 |
| EP | 0266785 A1 | 5/1988 |

(Continued)

OTHER PUBLICATIONS

"Articulated Loader 3550", Schaffer Loaders, https://www.schaffer-loaders.com.au/articulated-loader, retrieved Mar. 9, 2020, 18 pgs.

(Continued)

*Primary Examiner* — Tony H Winner
(74) *Attorney, Agent, or Firm* — Carlson, Caspers, Vandenburgh & Lindquist, P.A.

(57) ABSTRACT

A compact articulated-steering loader is provided. The loader includes a front portion having a first pair wheels and a seat reference point (SgRP) for an operator. The loader also includes a rear portion having a second pair of wheels, wherein the rear portion is coupled to the front portion via a vertical articulation axis. The loader includes one or a pair of loader arms coupled to the front portion via a horizontal arm pivot axis, the one or a pair of loader arms having a bucket or an attachment interface for a bucket at a distal portion thereof. The arm pivot axis is disposed to the rear of the SgRP. The loader also includes a power source disposed on the front frame. The power source is coupled to at least one of the first and second pairs of wheels to provide motive power for the loader.

25 Claims, 10 Drawing Sheets

(56) References Cited

U.S. PATENT DOCUMENTS

| | | | | |
|---|---|---|---|---|
| 4,154,456 | A | 5/1979 | Jensen et al. | |
| 4,381,900 | A | 5/1983 | Schlottman | |
| 4,401,408 | A | 8/1983 | Gibert | |
| 4,531,882 | A | 7/1985 | Pierre | |
| 4,705,449 | A * | 11/1987 | Christianson | E02F 9/163 180/6.5 |
| 6,062,334 | A | 5/2000 | Deneve et al. | |
| 6,293,579 | B1 * | 9/2001 | Schaeff | B60G 9/04 180/209 |
| 6,402,177 | B1 | 6/2002 | Carmona et al. | |
| 8,764,059 | B2 | 7/2014 | Borghi | |
| 2004/0172865 | A1 * | 9/2004 | Bainter | E02F 5/06 37/354 |
| 2013/0071214 | A1 * | 3/2013 | Itou | B60K 17/356 414/685 |
| 2014/0095036 | A1 * | 4/2014 | Hoff | E02F 9/2253 701/65 |
| 2015/0275932 | A1 * | 10/2015 | Vigholm | F15B 13/022 60/327 |
| 2017/0037602 | A1 * | 2/2017 | Spielman | E02F 9/2217 |

FOREIGN PATENT DOCUMENTS

| | | | |
|---|---|---|---|
| FR | 2552415 | A1 | 3/1985 |
| WO | 9721879 | A1 | 6/1997 |

OTHER PUBLICATIONS

"Articulated Loader vs. Skid Loader: Which One is Right for You?", Shank's MultiOne, http://www.shanksmultione.com/articulated-loader-vs-skid-loader-which-one-is-right-for-you/, retrieved Mar. 9, 2020, 4 pgs.

"Avant 200 Series", Avant Tecno Oy, 8 pgs., 2019.

"Optimas H99 Paver Laying Machine", www.optimas.de, retrieved Mar. 9, 2020, pp. 1-20.

* cited by examiner

COMPACT ARTICULATED-STEERING LOADER

BACKGROUND

Loader equipment comes in many different forms. These include front-end loaders, skid loaders, loader tractors, and variations of each. Each type of loader has advantages and disadvantages, such that the different loaders are more or less appropriate for different environments and/or tasks.

The first loaders were probably loader arms attached to a traditional farm tractor. Farm tractors are adapted primarily for pulling and operating implements attached to the rear portion of the tractor. Farm tractors typically steer by changing the orientation of the front wheels relative to the body of the tractor in the same general manner that on-road automobiles steer. Some of these tractors have loader arms that can be attached thereto to enable the tractor to be used as a loader in addition to its other functions, like pulling and operating implements. Because these tractors are designed primarily for operating implements attached to the rear, the operator is positioned near the rear of the tractor with the engine in front of the operator. This provides the operator good views of any implement attached behind the tractor. This configuration however, also places the operator far away from any loader bucket attached to the tractor, with the engine of the tractor blocking view of the loader bucket while it is down. Despite this disadvantageous loading configuration, loader tractors like these are still very useful, due to their ability to perform both loader and implement control with a single unit.

For larger scale loading environments, front-end loaders are typically used. Large front-end loaders are designed with use of the bucket on the front as the primary function. These large front-end loaders are adapted for off-road environments and for moving and lifting large quantities of material. These large front-end loaders typically steer via articulation. Articulated steering splits the loader into a front portion and a rear portion joined by an articulation joint. The cab and operator are usually positioned towards the middle of the loader with the engine behind the operator. The cab and operator are also positioned relatively high above the ground, behind and above the loader arms.

While front-end loaders like these provide good large-scale loading capabilities, they can be difficult to maneuver in tight spaces. Skid loaders were developed to fill this gap. Skid loaders have wheels that are fixed in orientation and steer by moving the wheels on one side of the loader at a different speed and/or in the opposite direction of the wheels on the other side. This manner of steering allows the loader to "skid" the tires and spin the entire machine about a vertical axis to turn.

Recently, smaller articulated steering loaders have been developed. These smaller articulated steering loaders maintain the same general design as large front-end loaders by having a centrally located cab with the engine behind the operator and the loader arms and bucket positioned in front of the operator.

BRIEF DESCRIPTION

Embodiments for an articulated-steering loader are provided. The loader includes a front portion having a first pair of transverse ground engaging wheels. The front portion defines a seat reference point (SgRP), which corresponds to a hip point of an operator of the loader. The loader also includes a rear portion having a second pair of transverse ground engaging wheels. The second pair of wheels are fixed in position relative to the rear portion, wherein the rear portion is coupled to the front portion via a vertical articulation axis. The loader also includes one or more articulation actuators coupled between the front portion and the second portion to pivot the rear portion relative to the front portion about the articulation axis. The loader also includes one or a pair of loader arms coupled to the front portion via a horizontal arm pivot axis, the one or a pair of loader arms having a bucket or an attachment interface for a bucket at a distal portion thereof. The arm pivot axis is disposed to the rear of the SgRP. The loader also includes one or more arm actuators coupled between the one or a pair of loader arms and the front portion to pivot the one or a pair of loader arms about the arm pivot axis. The loader also includes one or more power sources disposed on the front frame. The one or more power sources are coupled to at least one of the first and second pairs of wheels to provide motive power for the loader.

Embodiments for an articulated-steering loader are also provided. The loader includes a front frame having a plurality of front ground engaging wheels disposed thereon. The front wheels are mounted in a fixed orientation with respect to the front frame. The loader also includes a rear frame having a plurality of rear ground engaging wheels disposed thereon, wherein the rear wheels are mounted in a fixed orientation with respect to the rear frame, wherein the rear frame pivots about an articulation axis with respect to the front frame for steering of the loader. The rear wheels define a rear wheel rotation axis that is disposed underneath a portion of the front frame. The loader also includes one or a pair of arms pivotally coupled to the front frame about an arm pivot axis. The arm pivot axis is disposed rearward of the articulation axis. The one or a pair of arms extend from the arm pivot axis to a front of the loader along one or both lateral sides of the loader.

Embodiments for another loader are also provided. The loader includes a pair of front wheels rotating about a front wheel rotation axis on a front frame. The loader also includes a pair of rear wheels rotating about a rear wheel rotation axis on a rear frame and defining a wheelbase between the front wheel rotation axis and the rear wheel rotation axis in the range of 3 to 12 feet. The loader also includes an articulated-steering joint coupling the front frame to the rear frame. The articulated-steering joint pivoting about an articulation axis. The articulation axis is disposed a distance from the front wheel rotation axis in the range of 40% to 60% of the wheelbase. The front frame defines a seat reference point for an operator of the loader. The loader can include one or a pair of loader arms pivotally coupled to the front frame at a location that is at or rearward of the articulation axis. The one or more arms extend along one of both lateral sides of the operator to a front of the loader. The one or more loader arms configured to have thereon a forward-facing bucket. The loader can also include an engine disposed on the front frame rearward of the articulation axis. The rear rotation axis is disposed underneath a portion of the front frame.

DRAWINGS

Understanding that the drawings depict only exemplary embodiments and are not therefore to be considered limiting in scope, the exemplary embodiments will be described with additional specificity and detail through the use of the accompanying drawings, in which.

DETAILED DESCRIPTION

Figure 1:
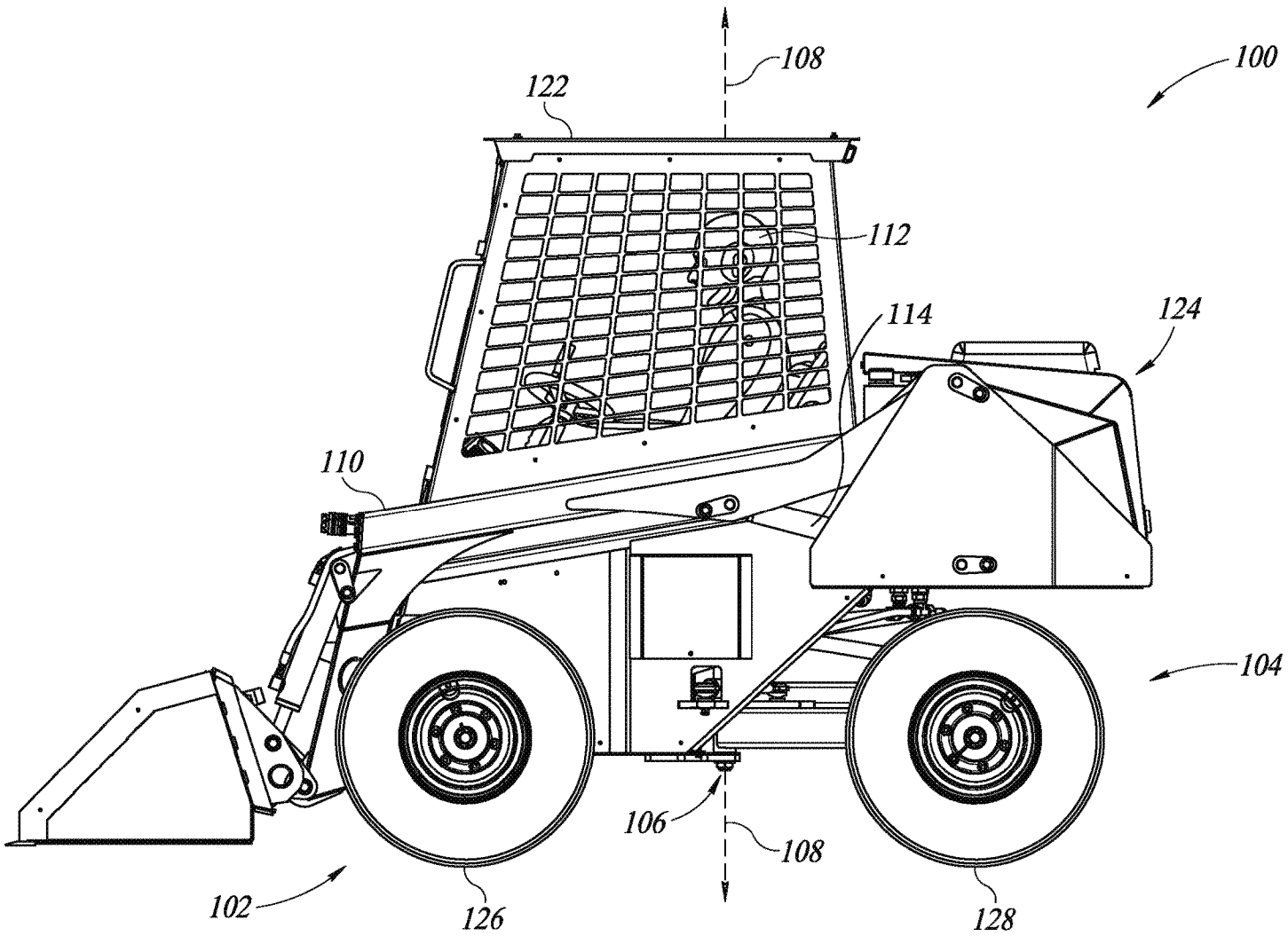
FIG. 1 is a side view of an example compact articulated-steering loader with the loader arms lowered.

FIG. 1 is a side view of an example compact articulated-steering loader 100 that provides excellent operator view of the bucket, good stability, a high bucket lift height, and non-skid steering, which enables the loader to be operated with reduced power among other things. The loader 100 has a front frame 102 and a rear frame 104 that are coupled together via an articulation joint 106. The articulation joint 106 defines a vertical articulation axis 108 about which the front frame 102 pivots relative to the rear frame 104. One or more articulation actuators (shown in FIG. 8), such as hydraulic cylinders, are coupled between the front frame 102 and the rear frame 104 to adjust and control the pivot angle of the rear frame 104 relative to the front frame 102.

The loader 100 also includes one or a pair of loader arms 110 disposed to the lateral side(s) of an operator 112. The loader 100 also includes one or more power sources 124, such as an internal combustion engine, electric motor, and/or hydraulic pump. One or more arm actuators 114, such as hydraulic cylinders, are coupled between the loader arm(s) 110 and the front frame 102 of the loader 100 to raise and lower the loader arm(s) 110. FIG. 1 is a view of the loader 100 with the loader arm(s) 110 in a lowered position. In an example, a cab 122 for an operator 112, the power source 124, and the loader arm(s) 110 are each disposed on the front frame 102.

Figure 2:
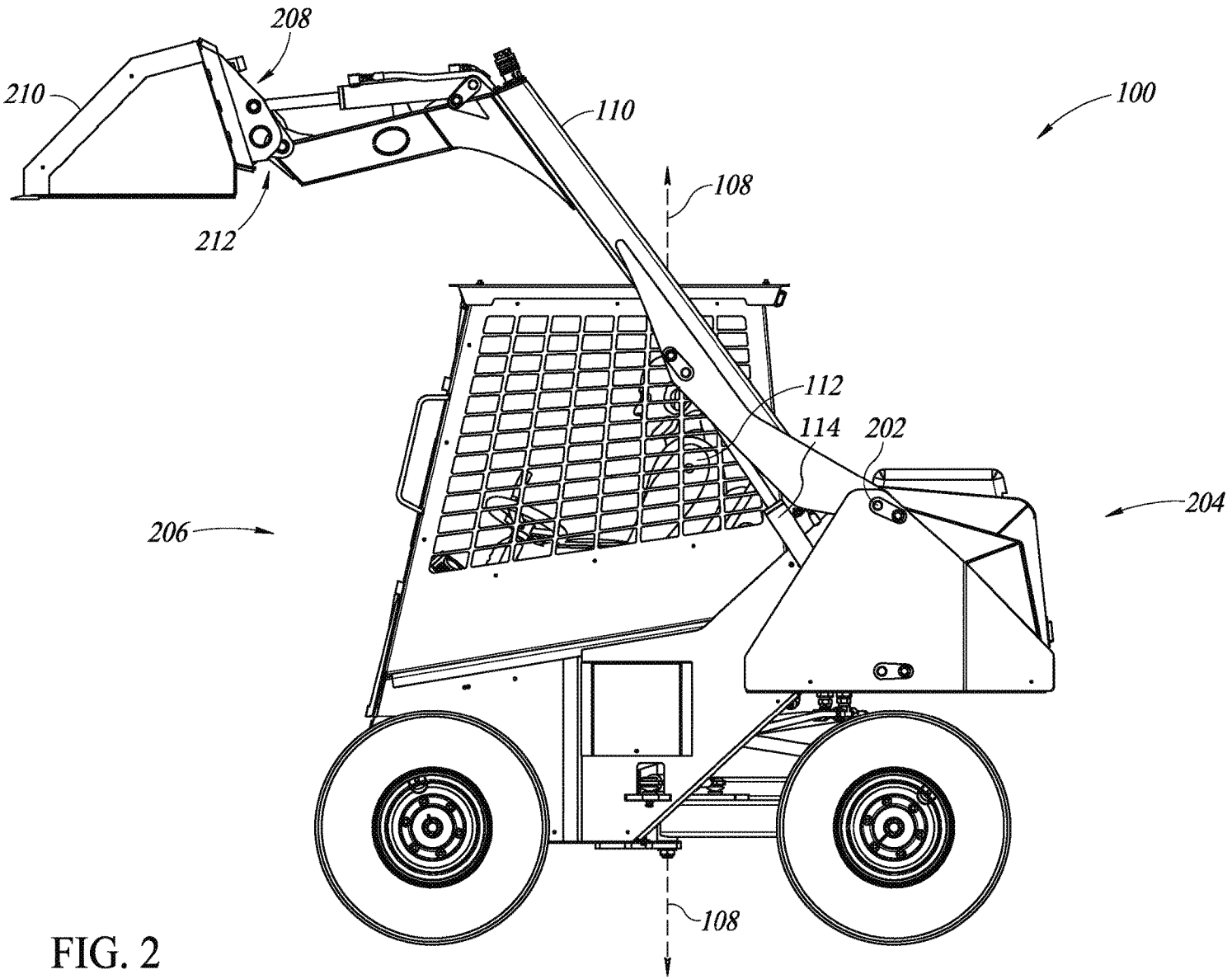
FIG. 2 is a side view of the loader of FIG. 1 with the loader arms raised.
Figure 3:
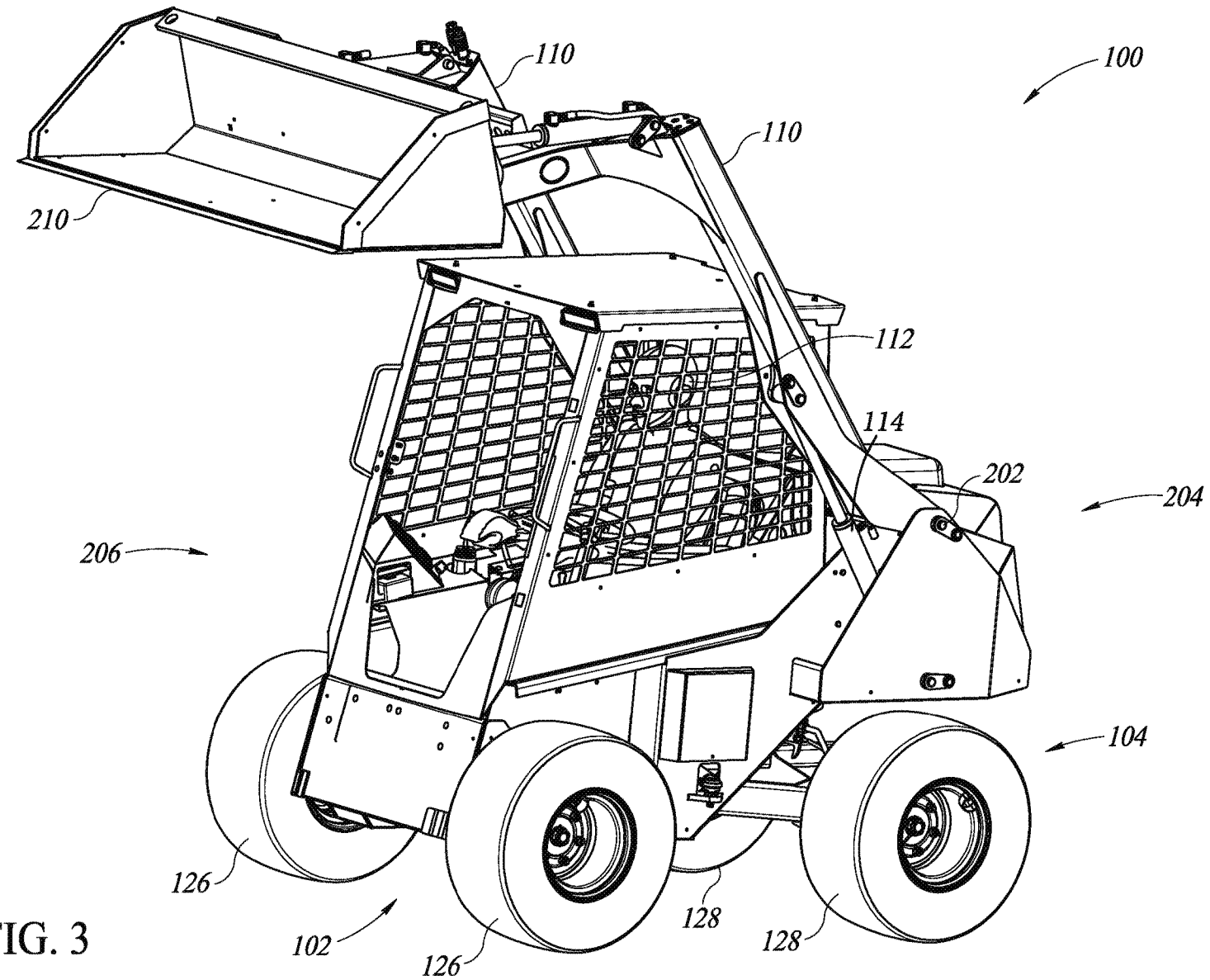
FIG. 3 is a perspective view of the loader of FIG. 2.

FIG. 2 is a side-view and FIG. 3 is a perspective view of the loader 100 with the loader arm(s) 110 in a raised position. In the example shown, the loader 100 includes a pair of loader arms 110, one on each lateral side of the operator 112. In another example the loader 100 includes a single loader arm extending on a single lateral side of the operator 112. In either case, the loader arm(s) 110 extend from an arm pivot axis 202 disposed toward a rear 204 of the loader 100 to an attachment interface 208, bucket 210, or other attachment disposed proximate a front 206 of the loader 100. The attachment interface 208, bucket 210, or other attachment is disposed at a distal end of the arm(s) 110. In an example, the attachment interface 208 has a forward-facing bucket 210 thereon for pushing forward into and scooping material (e.g., in a pile). The attachment interface 208 is a physical interface in which different attachments (e.g., bucket 210, sweeper, bush mower, rake, forks, etc.) can be removably attached thereto, such that the different attachments can be connected to and disconnected from the attachment interface 208 in the field to swap attachments on the loader 100. In other examples, a bucket 210 or other attachment (e.g., sweeper, bush mower, rake, forks, etc.) can be mounted to the loader arm(s) 110 in a manner in which disconnection in the field is not accommodated.

To move between lowered and raised positions, the loader arm(s) 110 pivot about the horizontal arm pivot axis 202. The arm pivot axis 202 is the axis about which the loader arm(s) 110 pivot relative to the body of the front frame 102. The loader arms) 110 can include a single articulation axis 212 between the arm pivot axis 202 and the attachment interface 208, bucket 210 or other attachment. This single articulation axis 212 can be disposed immediately behind the attachment interface 208, bucket 210, or other attachment and can be intended to enable the attachment interface 208, bucket 210, or other attachment to rotate relative to the arm(s) 110.

Figure 4:
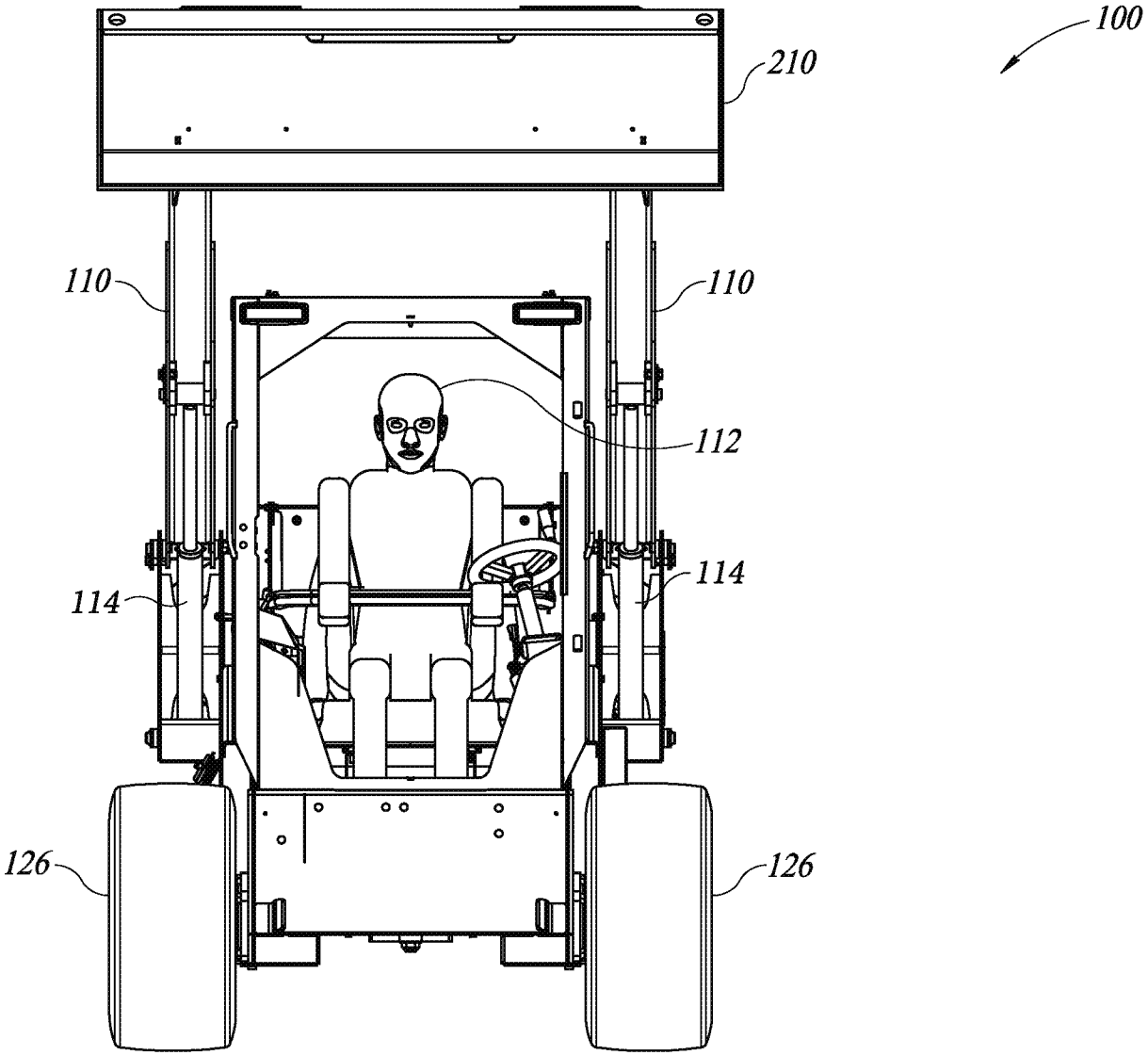
FIG. 4 is a front view of the loader of FIG. 2.
Figure 5:
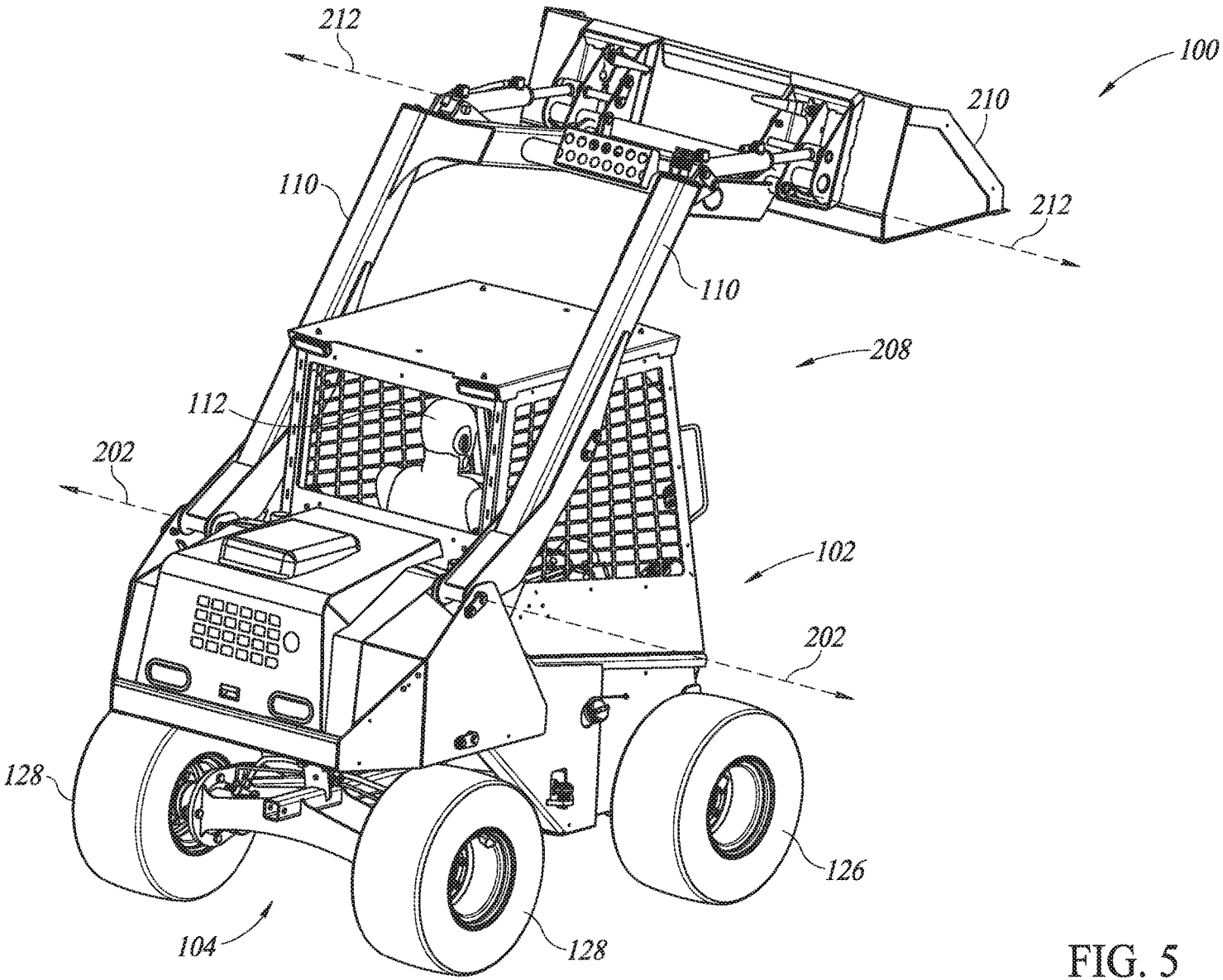
FIG. 5 is another perspective view of the loader of FIG. 2.
Figure 6:
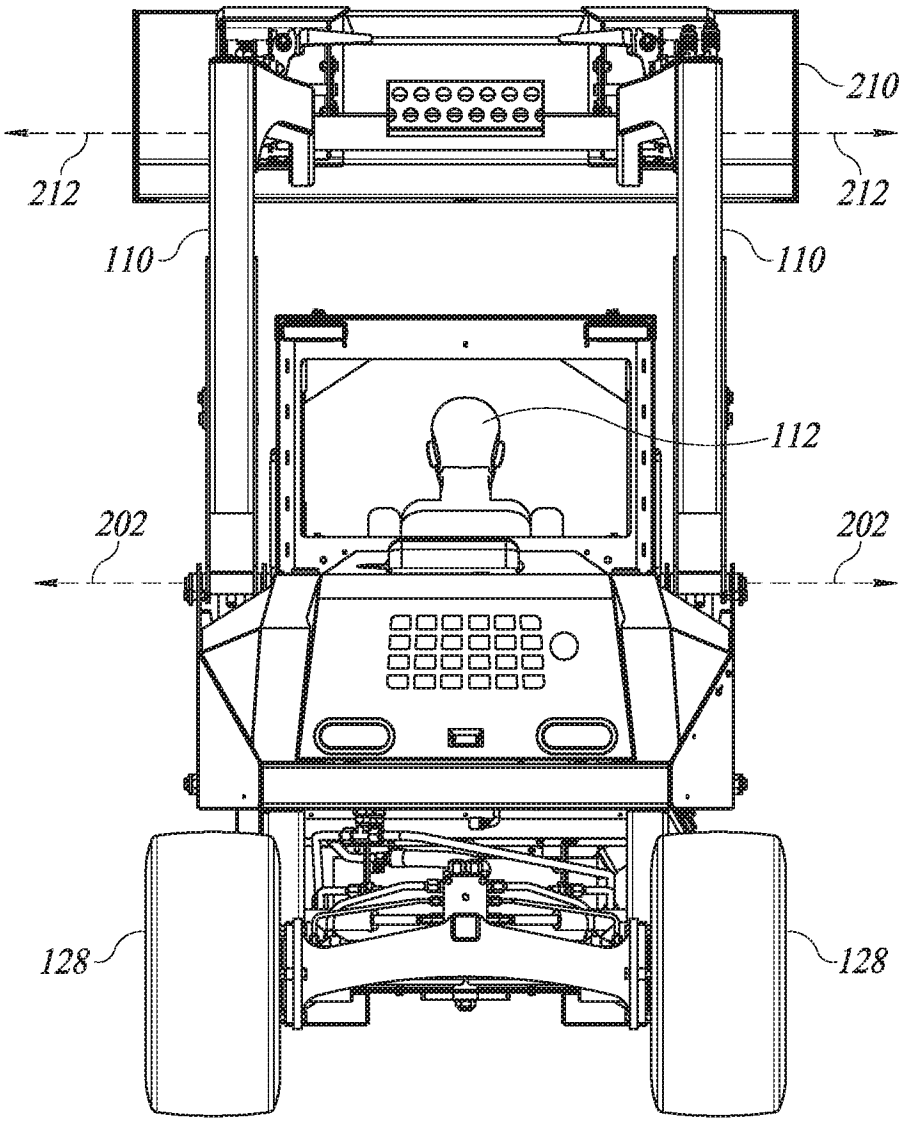
FIG. 6 is rear view of the loader of FIG. 2.

FIG. 4 is a front view, FIG. 5 is a rear-perspective view, and FIG. 6 is a rear view of the loader 100 with the loader arm(s) 110 in a raised position. As shown, the operator 112 is disposed generally in the lateral center (side-to-side) of the front frame 102. Additionally, the loader arm(s) 110 are disposed to the lateral side of the operator 112 between the arm pivot axis 202 and the front 208 of the loader 100.

As mentioned above the loader 100 includes a plurality of ground bearing wheels 126, 128 enabling the loader 100 to drive on the ground. The wheels 126, 128 include one or more front wheels 126 disposed on the front frame 102 of the loader 100 and one or more rear wheels 128 disposed on the rear frame 104 of the loader 100. In this example, the one or more front wheels 126 include a pair of front wheels 126 disposed on opposite lateral sides of the front frame 102. Similarly, the one or more rear wheels 128 include a pair of rear wheels 128 disposed on opposite lateral sides of the rear frame 104. The left and right wheel in a pair are disposed directly opposite one another laterally on their respective frame 102/104. Each pair of wheels 126, 128 is disposed in a fixed orientation relative to its respective frame 102, 104 of the loader 100. That is, the front pair of wheels 126 is disposed in a fixed orientation relative to the front frame 102 and the rear pair of wheels 128 is disposed in a fixed orientation relative to the rear frame 104. Thus, the front wheels 126 pivot along with the front frame 102 and the rear wheels 128 pivot along with the rear frame 104, such that as the rear frame 104 pivots relative to the front frame 102, the rear wheels 128 correspondingly pivot with respect to the front wheels 126.

FIGS. 1-6 illustrate the rear frame 104 of the loader 100 oriented straight relative to the front frame 102. In the straight orientation, the rear wheels 128 are oriented in the same direction as the front wheels 126 and the loader 100 drives in a straight direction forward or backward.

Figure 7:
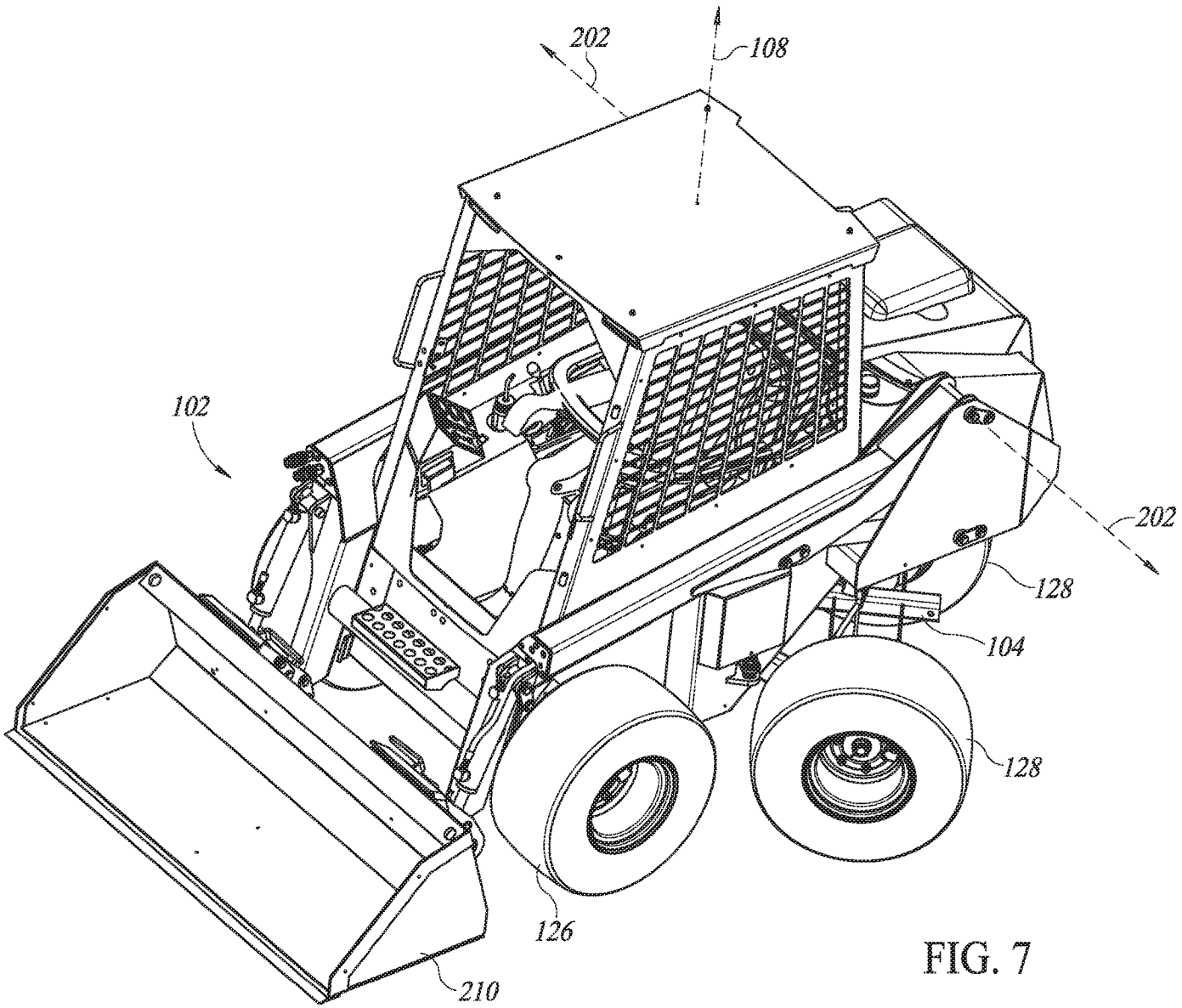
FIG. 7 is a perspective view of the loader of FIG. 1 with the rear frame pivoted at an angle with respect to the front frame.

FIG. 7 is a perspective view of the loader 100 with the rear frame 104 pivoted at an angle about the articulation axis 108 relative to the front frame 102. As discussed above, the wheels 126, 128 have a fixed orientation relative to their frame 102/104 of the loader 100, such that the rear frame 104 is pivoted to vary the orientation of the rear wheels 128 relative to the front wheels 126 and thereby steer the loader 100. While the rear frame 104 is pivoted relative to the front frame 102, the loader 100 will turn while driving forward or backward. The rear frame 104 can pivot both directions from the straight orientation to enable turning both to the left and to the right.

Figure 8:
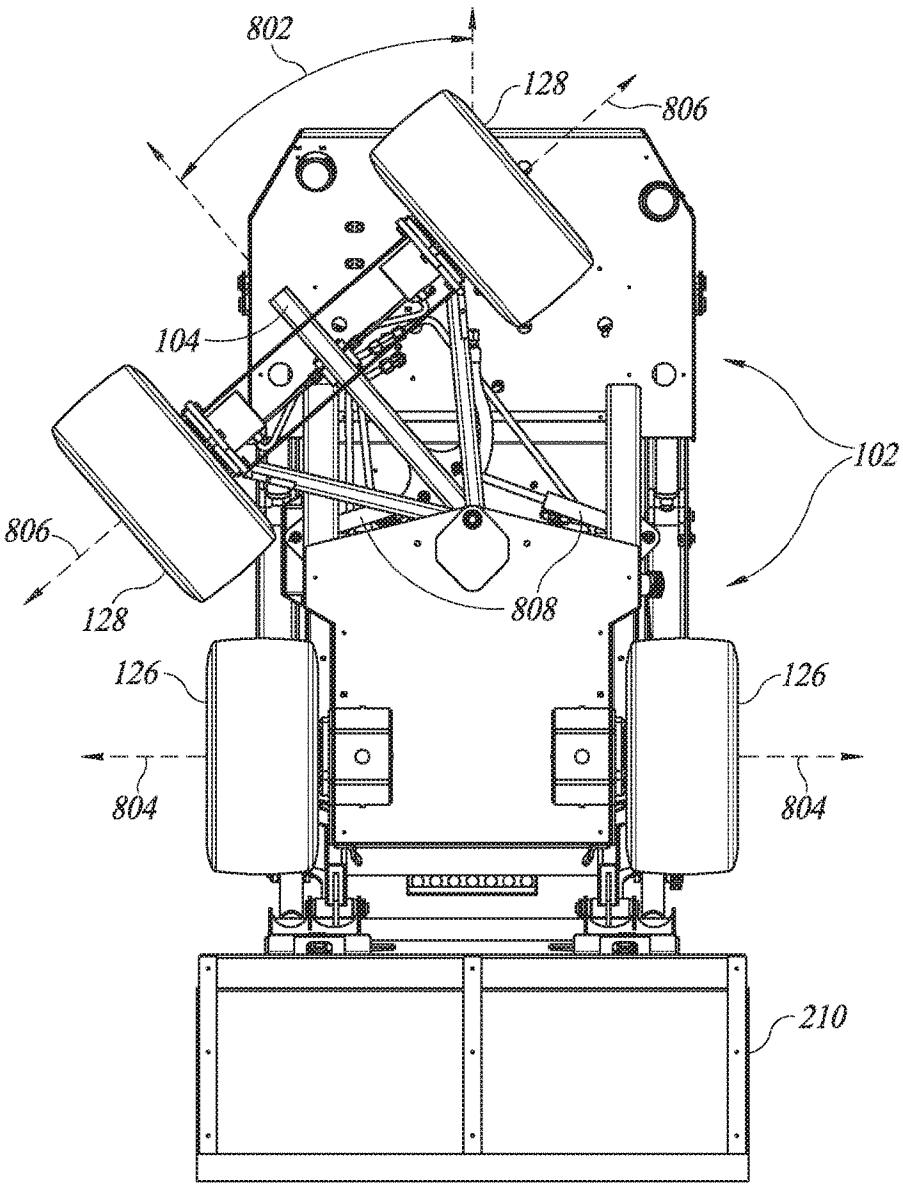
FIG. 8 is a bottom view of the loader of FIG. 7.

FIG. 8 is a bottom view of the loader 100 illustrating the rear frame 104 pivoted at an angle 802 with respect to the front frame 102. One or more articulation actuators 808 (e.g., hydraulic cylinders) can be coupled between the front frame 102 and the rear frame 104 to pivot the rear frame 104. Pivoting the rear frame 104, pivots the rotation axis 806 of the rear wheels 128 with respect to the rotation axis 804 of the front wheels. In an example the rear frame 104 can pivot up to a maximum angle 802 of 30-50 degrees from the straight orientation in both directions. In a more specific example, the rear frame 104 pivots at an angle 802 from 0 to 45 degrees relative to the front frame 102.

Articulated steering can be advantageous as compared to skid steering for a small loader because it enables the loader 100 to turn with less disruption to the ground below. For example, when working on a construction site, the articulated steering enables the loader 100 to turn with less tear on the ground than skid steering does. Additionally the reduction in skidding reduces wear on the tires and enables a lower pressure tire to be used. Finally skid steer loaders have a shorter wheelbase (distance between the front and rear wheels) relative to other loaders to enable easier skidding. By using articulated steering, the loader 100 described herein can have a longer wheelbase than comparable skid loaders. The longer wheelbase provides increased stability and a more comfortable ride for the loader 100. Articulated steering also requires less power than skidding and provides a smooth infinitely variable steering experience.

Figure 9:
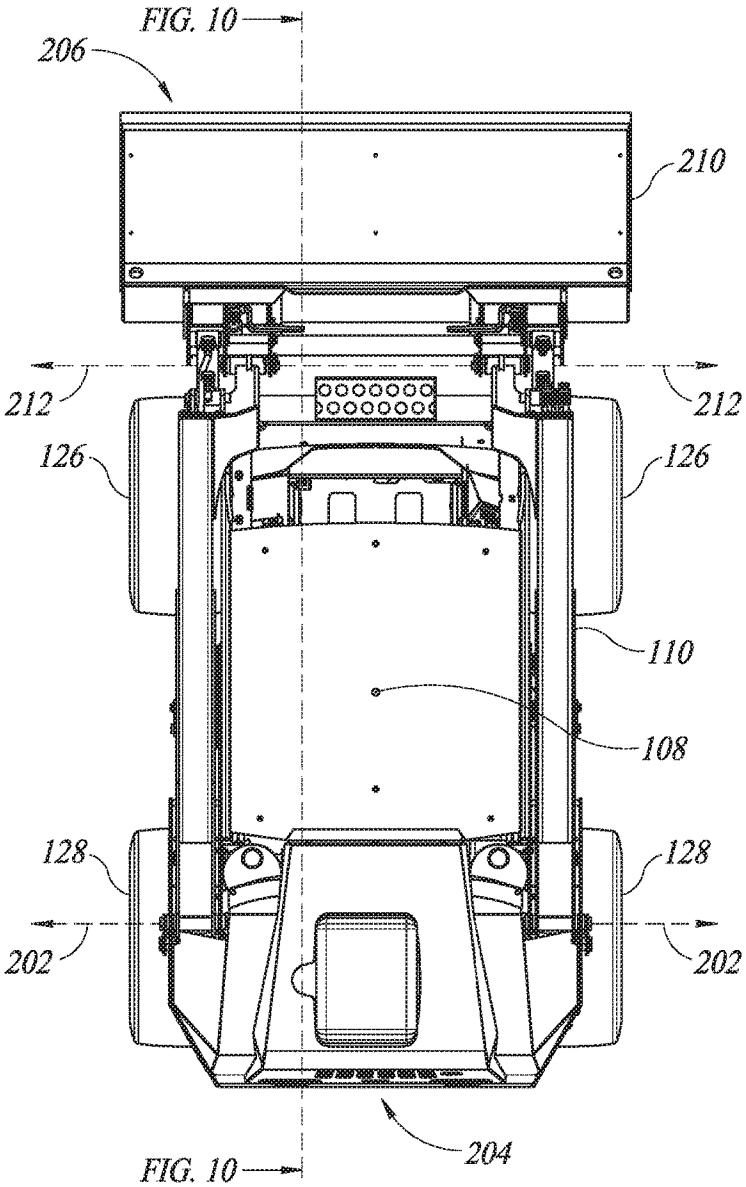
FIG. 9 is a top view of the loader of FIG. 1.

FIG. 9 is a top view of the loader 100. As shown, the loader arm(s) 110 extend from the arm pivot axis 202 to the front 206 of the loader 100. Existing articulated steering loaders dispose the loader arms on the front portion in front of the articulation axis of the loader because the loader arms themselves cannot bend when the loader articulates. Thus, the loader arms are disposed in front of the articulation axis allowing the rear portion to pivot relative to front portion without encumbrance from the loader arms. This disposes the arm pivot axis of existing articulated steering loaders in front of the articulation axis and also in front of the operator.

In an example, the arm pivot axis 202 is disposed at or rearward of the articulation axis 108. In another example, the arm pivot axis 202 is disposed rearward of the operator 112. In yet another example, the arm pivot axis 202 is disposed rearward of both the operator 112 and the articulation axis 108. In examples where the arm pivot axis 202 is disposed at or rearward of the articulation axis the arm pivot axis 202 can be disposed at least 1 foot or at least 2 feet rearward of the articulation axis 108.

Disposing the arm pivot axis 202 at any of these rearward positions can provide a more compact loader design relative to the length and orientation of the loader arms 110. Longer loader arms 110 can be desirable as they enable a higher lift height and/or improved radius of lift for the bucket 210. In respective examples, the distance from the arm pivot axis 202 to the bucket pivot axis 212 is at least 4 feet or at least 5 feet. In an example, the attachment interface 208/bucket 210 has a vertical movement range of at least 7 feet. In an example, the attachment interface 208/bucket 210 is disposed proximate the ground when the arms 110 are in the lowered position and can clear 7 feet above the ground when in the raised position.

Disposing the arm pivot axis 202 to the rear of the operator 112 also places the operator 112 closer to the attachment interface 208 or bucket 210 on the end of the arms 110. This provides the operator 112 with good views of an attachment (e.g., bucket 210) on the attachment interface 208 without requiring the operator 112 to be disposed high above the ground. This, in turn, enables the operator 112 and overall center of gravity of the loader 100 to be lower, increasing stability and allowing lower working overhead clearances. Additionally, as mentioned above, steering via articulation enables a longer wheelbase. All these advantages put together into a single loader provides a compact, maneuverable, and stable loader 100 that is well adapted for light construction, landscaping and other similar uses.

To enable the arm pivot axis 202 to be disposed behind the articulation axis 108 the rear frame 104 is disposed underneath a portion of the front frame 102. In this example the rear wheels 128 are disposed to pivot underneath a portion of the front frame 102. In most existing articulated loaders, the rear wheels pivot about an area that is completely behind the front frame.

Figure 10:
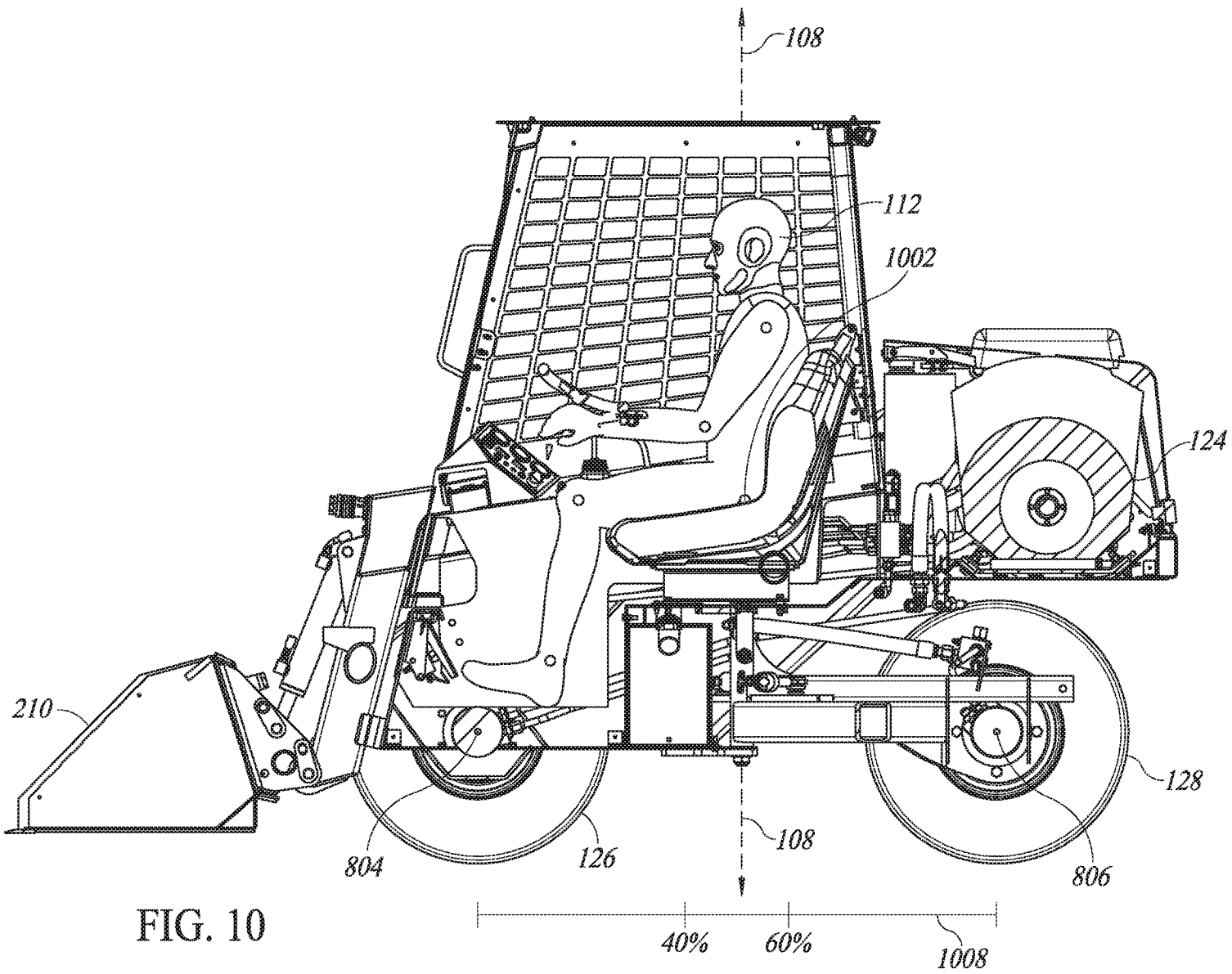
FIG. 10 is a section view of the loader of FIG. 9.

FIG. 10 is a section view of the loader 100 taken down the line 10-10 of FIG. 9. Each pair of ground bearing wheels 126, 128 of the loader 100 defines a rotation axis 804, 806 that extends laterally across the respective frame (front 102, rear 104) of the loader 100. A given pair of wheels 126, 128 rotates about a common rotation axis 804, 806. The front pair of wheels 126 rotates about the front rotation axis 804 and the rear pair of wheels 128 rotates about the rear rotation axis 806.

The operator location in a vehicle is often defined during design by a seat reference point (SgRP) 1002. The seat reference point 1002 corresponds to a hip point of the operator while sitting in the vehicle during operation. The SgRP 1002 is laterally centered on the operator's body at a vertical location corresponding to the hip. In the example loader shown in FIG. 10, the SgRP 1002 is disposed on the front frame 102 such that the disposition of the SgRP 1002 relative to the front rotation axis 804 is fixed. In an example, the SgRP 1002 is approximately aligned with the vertical articulation axis 108 providing minimal translation of the operator during articulation of the loader 100. In other examples, the SgRP is disposed within one of 3 inches, 6 inches, 1 foot, 3 feet, or 5 feet of the articulation axis 108 in either the forward or rearward directions.

In an example, the SgRP 1002 of the loader 100 is disposed between the front rotation axis 804 and the rear rotation axis 806 at a distance from the front rotation axis 804 that is 40% to 60% of the distance 1008 to the rear rotation axis 806. In a more specific example, the SgRP 1002 is disposed about halfway between (equally spaced from) the front rotation axis 804 and the rear rotation axis 806.

In an example, the articulation axis 108 of the loader 100 is disposed between the front rotation axis 804 and the rear rotation axis 806 at a distance from the front rotation axis 804 that is 40% to 60% of the distance 1008 to the rear rotation axis 806. In a more specific example, the articulation axis 108 is disposed about halfway between (equally spaced from) the front rotation axis 804 and the rear rotation axis 806. Disposing the articulation axis 108 in the middle or roughly in the middle of the wheel rotation axes 804, 806 provides a balance between high speed (e.g., 1248 mph) driving stability and bucket load carrying stability.

The distance 1008 between the front wheel rotation axis 804 and the rear wheel rotation axis 806 while the rear frame 104 is oriented straight with respect to the front frame 102 is commonly referred to as the wheelbase. In an example, the wheelbase 1008 is at least 3 feet long. In respective examples, the wheelbase 1008 is in the range of 3 to 8 or 3 to 12 feet.

In an example, the arm pivot axis 202 is disposed lower than 3 feet above the SgRP 1002. In other examples, the arm pivot axis 202 is disposed lower than 2 feet or 1 foot above the SgRP 1002. In yet other examples, the arm pivot axis 202 is disposed at or lower than the SgRP 1002. In still other examples, the arm pivot axis 202 is disposed lower than a top of the operator's 112 roll-over protection (e.g., roll cage or roll bar(s)) extending above the SgRP 1002. Any of these locations of arm pivot axis 202 can dispose the arm pivot axis 202 within 5 feet of the ground in a smaller loader. Since the arm(s) 110 extend along the sides of the operator 112, disposing the arm pivot axis 202 at this lower location enables the arms 110 to extend low within an operator's 112 field of view to the sides. While arm(s) 110 are in a fully lowered position, a top of the arm(s) 110 at a point longitudinally (front-to-back) aligned with the SgRP 1002 can be disposed lower than 2 feet or 1 foot above the SgRP 1002. In other examples, the point on the arm(s) 110 that is longitudinally aligned with the SgRP 1002 can be disposed at or lower than the SgRP 1002.

In an example, the power source 124 (e.g., the engine) for the loader 100 is disposed on the front frame 102 of the loader 100. Disposing the power source 124 on the front frame 102 reduces the components on the rear frame 104, enabling the rear frame 104 to be smaller. Having a smaller rear frame 104 enables it to fit more easily underneath a portion of the front frame 102. In an example the power source 124 is disposed on the front frame 102 and rearward of the articulation axis 108. Disposing the power source 124 on the front frame 102 in this rearward location can provide increased stability for the loader 100 while lifting loads with the bucket 210. That is, the weight of the power source 124 disposed to the rear 204 of the front frame 102 proximate the rear wheel rotation axis 806 can counterbalance the load lifted by the bucket 210 which is proximate the front 206 of the loader 100. Moreover, by disposing the power source 124 on the front frame 102 rather than the rear frame 104, this counterbalancing effect is consistently present regardless of the pivot angle 802 of the rear frame 104 relative to the front frame 102.

As discussed above, the arm pivot axis 202 can also be disposed on the front frame 102 rearward of the articulation axis 108. In respective examples, the arm pivot axis 202 can be disposed within 2 feet or within 1 foot forward or rearward of the rear wheel rotation axis 806 while the rear frame 104 is oriented straight with respect to the front frame 102. In a more specific example the arm pivot axis 202 is approximately vertically aligned with the rotation axis 806 of the rear wheels 128 while the rear frame 104 is oriented straight with respect to the front frame 102. In still other examples, the arm pivot axis 202 is disposed rearward of the rotation axis 806 of the rear wheels 128 while the rear frame 104 is oriented straight with respect to the front frame 102.

The power source 124 can be coupled to one or more of the front wheels 126 and the rear wheels 128 to provide motive power for the loader 100. In an example, the power source 124 can also be coupled to the actuator(s) 114 for the loader arms 110 and the articulation actuator(s) 808 to provide power for moving the arms 110 and steering the loader 100. The power source 124 can be coupled to wheels 126, 128, the arm actuator(s) 114, and articulation actuator (s) 808 in any suitable manner to transfer power from the power source 124 to the wheels/actuator(s).

In an example, the power source 124 is coupled to one or more of the wheels 126, 128/actuator(s) 808, 114 via a hydraulic drive system. In such an example, the power source 124 can include an internal combustion engine or electric motor coupled to the hydraulic drive system. The hydraulic drive system can include a hydraulic pump coupled to the internal combustion engine or electric motor. The hydraulic can be coupled via respective hydraulic fluid lines to the wheels 126, 128, arm actuator(s) 114 and/or articulation actuator(s) 808.

In an alternative example, the power source 124 can be coupled to one or more of the wheels 126, 128, arm actuator(s) 114, and articulation actuator(s) 808 via an electric drive system. In such an alternative example, the power source 124 can include a battery back and that is electrically coupled to the electric drive system, which can include an electric motor or electric actuator(s) at the wheels 126, 128, arm actuator(s) 114 and/or articulation actuator(s) 808.

The battery pack can be disposed on the front frame 102 rearward of the articulation axis 806 corresponding to the location of the power source 124 shown in the figures herein. In an implementation of the electric drive system, a main electric motor can be disposed proximate the battery pack on the front frame 102 and can power a hydraulic pump which drives the ground bearing wheels 126, 128. This hydraulic pump can also drive the other actuators (e.g., articulation actuators 808 and arm pivot actuators) on the loader 100. Alternatively, the main electric motor can power one or more separate hydraulic pumps that drive the other actuators (e.g., articulation actuators 808 and arm pivot actuators) on the loader 100.

In an implementation of the electric drive system, each wheel 126, 128 or each pair of wheels 126, 128 can be driven by a distinct electric motor that is disposed on the respective frame (front 102, rear 104) proximate the wheel 126, 128 or pair of wheels 126, 128. Each electric motor can be electrically coupled to the battery pack, which can be disposed on the rear portion of the front frame 102 in a position corresponding to the location of the power source 124 described herein. In such an implementation, a first electric motor can be disposed on the front frame 102 proximate a first of the front wheels 126 and a second electric motor can be disposed on the front frame 102 proximate a second of the front wheels 126. A third electric motor can be disposed on the rear frame 104 proximate a first of the rear wheels 128 and a fourth electric motor can be disposed on the rear frame 104 proximate a second of the rear wheels 128. In such an implementation, one or more additional electric motors, distinct from any electric motors driving the wheels 126, 128, can be coupled to the battery pack to drive any other actuators (e.g., articulation actuators 808 and arm pivot actuators 114) on the loader 100 either directly or via a hydraulic pump and drive system.

In yet other examples, the power source 124 can be coupled to one or more of the wheels 126, 128, arm actuator(s) 114, and articulation actuator(s) 808 via mechanical drivetrain, such as a belt, chain, and/or gear/axle drive.

The power source 124 can also provide power to the other actuators, such as actuators on attachments connected to the attachment interface 208 of the loader 100.

Regardless of the type of power source 124, the articulating steering of the loader 100 requires less power to drive than a comparable skid-steering loader, so the size of the power source 124 can be smaller relative to a comparable skid-steering loader. A smaller power source also provides better sight lines for the operator 112 to the rear 204 of the loader 100 when the power source is disposed behind the operator 112 as in the example herein.

The power source 124, drive system for motive power of the loader 100, arm actuator(s) 114 and articulation actuator(s) 808 as well as other actuators of the loader 100 can be controlled by the operator 112 with suitable controls within operator reach while at the SgRP 1002.

What is claimed is:

1. An articulated-steering loader comprising:

a front portion having a first pair of transverse ground engaging wheels, wherein the front portion defines a seat reference point (SgRP);

a rear portion having a second pair of transverse ground engaging wheels, wherein the second pair of wheels are fixed in position relative to the rear portion, wherein the rear portion is coupled to the front portion via a vertical articulation axis;

one or more articulation actuators coupled between the front portion and the second portion to pivot the rear portion relative to the front portion about the vertical articulation axis;

one or a pair of loader arms coupled to the front portion via a horizontal arm pivot axis, the one or a pair of loader arms having a bucket or an attachment interface for a bucket at a distal portion thereof, wherein the arm pivot axis is disposed to the rear of the SgRP;

one or more arm actuators coupled between the one or a pair of loader arms and the front portion to pivot the one or a pair of loader arms about the arm pivot axis; and one or more power sources disposed on the front frame, the one or more power sources coupled to at least one of the first and second pairs of wheels to provide motive power for the loader.

2. The loader of claim 1, wherein the first pair of wheels has a fixed orientation relative to the front portion and the second pair of wheels has a fixed orientation relative to the rear portion.

3. The loader of claim 2, wherein the SgRP is fixed relative to the first pair of wheels.

4. The loader of claim 1, wherein the one or a pair of loader arms have a single articulation axis proximate to and rearward of the attachment interface or bucket.

5. The loader of claim 1, wherein the arm pivot axis is lower than a point 3 feet above the SgRP.

6. The loader of claim 5, wherein the arm pivot axis is lower than a point 2 feet above the SgRP.

7. The loader of claim 1, wherein the articulation axis is disposed between a front rotation axis defined by the first pair of wheels and a rear rotation axis defined by the second pair of wheels at a distance from the front rotation axis in a range of 40% to 60% of the distance to the rear rotation axis.

8. The loader of claim 1, wherein a distance from the arm pivot axis to a pivot axis for the bucket or attachment interface is at least 4 feet.

9. The loader of claim 1, wherein the one or a pair of arms extend from the arm pivot axis to a front of the loader, wherein while the one or a pair of arms are in a fully lowered position, at a point longitudinally aligned with the SgRP, the one or a pair of arms are disposed lower than 2 feet above the SgRP.

10. The loader of claim 1, wherein the one or more power sources include one or more of an internal combustion engine, a battery pack, an electric motor, and a hydraulic pump.

11. The loader of claim 10, wherein an axis defined by the second pair of wheels extends underneath a portion of the front portion, and wherein the at least one of the internal combustion engine, battery pack, electric motor, or hydraulic pump is disposed behind the vertical articulation axis and above the second pair of wheels.

12. The loader of claim 11, wherein the at least one of the internal combustion engine, battery pack, electric motor, or hydraulic pump provides motive power for the first pair of wheels and second pair of wheels.

13. The loader of claim 1, wherein the one or a pair of arms are disposed to one or both lateral sides of the SgRP of the loader.

14. The loader of claim 1, wherein the arm pivot axis is disposed to a rear of the vertical articulation axis.

15. The loader of claim 14, wherein the arm pivot axis is disposed at least 1 foot to the rear of the articulation axis.

16. The loader of claim 1, wherein the SgRP is within 2 feet of the articulation axis.

17. The loader of claim 1, wherein the one or more power sources are disposed rearward of the SgRP.

18. The loader of claim 1, wherein the one or more power sources are coupled to:

the one or more articulation actuators to provide power for steering the loader; and the one or more arm actuators to provide power to pivot the one or a pair of loader arms about the arm pivot axis.

19. An articulated-steering loader comprising:

a front frame having a plurality of front ground engaging wheels disposed thereon, wherein the front wheels are mounted in a fixed orientation with respect to the front frame;

a rear frame having a plurality of rear ground engaging wheels disposed thereon, wherein the rear wheels are mounted in a fixed orientation with respect to the rear frame, wherein the rear frame pivots about an articulation axis with respect to the front frame for steering of the loader, wherein the rear wheels define a rear wheel rotation axis that is disposed underneath a portion of the front frame; and one or a pair of arms pivotally coupled to the front frame about an arm pivot axis, the arm pivot axis disposed rearward of the articulation axis, the one or a pair of arms extending from the arm pivot axis to a front of the loader along one or both lateral sides of the loader.

20. The articulated-steering loader of claim 19, wherein the arm pivot axis is disposed within 2 feet forward or rearward of the rear wheel rotation axis while the rear frame is oriented straight with respect to the front frame.

21. The articulated-steering loader of claim 19, wherein the arm pivot axis is disposed lower than a top of a roll-over protection of the loader.

22. The articulated-steering loader of claim 19, wherein the front frame defines a seat reference point for an operator of the loader.

23. The articulated-steering loader of claim 19, wherein the arm pivot axis is disposed at least 1 foot rearward of the articulation axis.

24. The articulated-steering loader of claim 23, wherein the seat reference point is within 2 feet of the articulation axis.

25. A loader comprising:

a pair of front wheels rotating about a front wheel rotation axis on a front frame;

a pair of rear wheels rotating about a rear wheel rotation axis on a rear frame and defining a wheelbase between the front wheel rotation axis and the rear wheel rotation axis in the range of 3 to 12 feet;

an articulated-steering joint coupling the front frame to the rear frame, the articulated-steering joint pivoting about an articulation axis, the articulation axis disposed a distance from the front wheel rotation axis in a range of 40% to 60% of the wheelbase, wherein the front frame defines a seat reference point for an operator of the loader;

one or a pair of loader arms pivotally coupled to the front frame at a location that is at or rearward of the articulation axis, the one or a pair of loader arms extending along one of both lateral sides of the seat reference point to a front of the loader, the one or a pair of loader arms configured to have thereon a forward facing bucket; and an engine or battery pack disposed on the front frame rearward of the articulation axis, wherein the rear rotation axis is disposed underneath a portion of the front frame.

* * * * *